US011441432B2

(12) United States Patent
Zhang

(10) Patent No.: US 11,441,432 B2
(45) Date of Patent: Sep. 13, 2022

(54) TURBINE BLADE AND METHOD

(71) Applicant: PRATT & WHITNEY CANADA CORP., Longueuil (CA)

(72) Inventor: Chao Zhang, Vaughan (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 297 days.

(21) Appl. No.: 16/533,966

(22) Filed: Aug. 7, 2019

(65) Prior Publication Data

US 2021/0040860 A1 Feb. 11, 2021

(51) Int. Cl.

| | |
|---|---|
| ***F01D 5/30*** | (2006.01) |
| ***F01D 11/00*** | (2006.01) |
| ***F01D 5/08*** | (2006.01) |

(52) U.S. Cl.

CPC ..... *F01D 5/3015* (2013.01); *F01D 5/081* (2013.01); *F01D 11/006* (2013.01); *F05D 2230/60* (2013.01); *F05D 2240/55* (2013.01); *F05D 2240/81* (2013.01); *F05D 2260/36* (2013.01)

(58) Field of Classification Search

CPC ..... F01D 5/3015; F01D 5/081; F01D 5/082; F01D 5/084; F01D 11/006

See application file for complete search history.

(56) References Cited

U.S. PATENT DOCUMENTS

| | | | | |
|---|---|---|---|---|
| 3,748,060 | A * | 7/1973 | Hugoson | F01D 5/3015 416/92 |
| 4,021,138 | A * | 5/1977 | Scalzo | F01D 5/081 416/95 |
| 6,296,172 | B1 * | 10/2001 | Miller | B23K 20/10 228/110.1 |
| 8,425,194 | B2 | 4/2013 | Liotta et al. | |
| 8,444,387 | B2 * | 5/2013 | Morris | F01D 5/082 416/96 R |
| 8,951,017 | B2 | 2/2015 | Cordier et al. | |
| 2013/0323031 | A1 * | 12/2013 | Zhang | F01D 5/22 415/173.1 |
| 2016/0305259 | A1 | 10/2016 | Evans et al. | |
| 2018/0038381 | A1 | 2/2018 | Colletti et al. | |
| 2020/0277866 | A1 * | 9/2020 | Dos Santos | F01D 5/3015 |

* cited by examiner

*Primary Examiner* — Christopher Verdier
*Assistant Examiner* — Michael K. Reitz
(74) *Attorney, Agent, or Firm* — Norton Rose Fulbright Canada LLP

(57) ABSTRACT

The turbine blade includes an airfoil, a root connected to the airfoil and having lobed edges spaced apart on laterally opposed sides of an axis extending axially through the root, and an air passage extending through the airfoil and the root. A first tab extends at least partially along and laterally outward from a first edge of the laterally opposed lobed edges, and a second tab extending at least partially along and laterally outward from a second edge of the laterally opposed lobed edges.

17 Claims, 4 Drawing Sheets

TURBINE BLADE AND METHOD

TECHNICAL FIELD

The application relates generally to turbine rotors for gas turbine engines, and more particularly to turbine blades.

BACKGROUND

Turbine blades spin at very high speeds and must be reliably retained on the turbine disc. As well, because of the high temperatures to which they are exposed, turbine blades are often cooled. This is typically done using cooling air, which may be directed into cooling inlets formed in the blades. Sealing of the turbine blades is therefore also an important consideration, as excessive leakage of cooling air is undesirable.

SUMMARY

There is accordingly provided a turbine blade, comprising: an airfoil; a root connected to the airfoil and having lobed edges being spaced apart on laterally opposed sides of an axis extending axially through the root; an air passage extending through the airfoil and the root; a first tab extending at least partially along and laterally outward from a first edge of the laterally opposed lobed edges; and a second tab extending at least partially along and laterally outward from a second edge of the laterally opposed lobed edges.

The turbine blade may also include, one or more of the following elements/features, in whole or in part, and in any combination.

The first tab includes a plurality of first tabs extending along the first edge, and the second tab includes a plurality of second tabs extending along the second edge.

The first tabs are spaced from each other along the first edge and the second tabs are spaced from each other along the second edge.

The lobed edges are disposed on an upstream-facing surface of the root.

A seal at a bottom of a downstream-facing surface of the root, the downstream-facing surface being opposite the upstream-facing surface.

A seal including a plurality of projections extending downward from a rest of the root, and the seal is defined in part by the downstream-facing surface.

Each of the first and second tabs conforms in shape to a portion of the corresponding one of the first and second edges along which that first tab extends.

The lobed edges are fir-tree shaped.

A turbine rotor, comprising a disc rotatable about a rotation axis and the turbine blade as defined above, the disc defining an axially-extending lobed slot therein, the root being lobed and being received in the lobed slot, the airfoil portion of the turbine blade extending radially outward from the lobed slot and the disc relative to the rotation axis.

The air passage is a first air passage, the root, the seal, and the disc define a second air passage between the root, the seal, and the disc, the first air passage being fluidly connected to the second air passage.

A cover plate attached to an upstream-facing surface of the disc, the cover plate and the upstream-facing surface of the disc defining a third air passage between the cover plate and the upstream-facing surface of the disc, the third air passage being fluidly connected to the second air passage.

The lobed edges of the root and opposed surfaces of the disc define gaps between the lobed edges and corresponding ones of the opposed surfaces of the disc, and the first and second tabs fluidly block at least parts of corresponding ones of the gaps.

The first and second tabs are disposed between the root and the cover plate.

The lobed slot is a fir-tree-shaped slot, a plurality of the fir-tree-shaped slots defined in the disc at circumferentially distributed locations about a periphery of the disc, and a plurality of turbine blades each having the root thereof received in a corresponding one of the fir-tree-shaped slots.

There is also provided, in accordance with another aspect of the present disclosure, a turbine rotor for a gas turbine engine, comprising: a disc rotatable about a rotation axis and having a circumferential array of slots therein, slots extending generally axially in the disc relative to the rotation axis; a plurality of turbine blades received in the slots, the blades having a fir-tree-shaped roots configured with the slot to for a mating connection between the disc and the turbine blades; the turbine blades having one or more tabs extending laterally from a lateral outer edge of the fir-tree-shaped roots on circumferentially opposite sides of fir-tree-shaped roots, the one or more tabs extend over a surface of the disc thereby sealing a lateral portion of a gap defined between the fir-tree-shaped roots and the disc.

The turbine rotor may also include, one or more of the following elements/features, in whole or in part, and in any combination.

The one or more tabs are integrally formed with the fir-tree-shaped roots.

The one or more tabs include a plurality of tabs spaced apart from each other and conforming in shape to the lateral outer edges of the fir-tree-shaped roots.

A cover plate connected to an upstream-facing side of the disc and defining a first air passage between the cover plate and the disc, and wherein the disc and the given turbine blade define a second air passage fluidly connected to the first air passage and extending through the root of the given turbine blade to an airfoil portion of the given turbine blade.

There is further provided, in accordance with another aspect of the present disclosure, a method of constructing a rotor assembly for a gas turbine engine, comprising: constructing a disc of a rotor for the gas turbine engine for rotation about a rotation axis, including defining an axially-extending fir-tree-shaped slot in a periphery of the disc, mating a fir-tree-shaped root of a blade to the fir-tree-shaped slot, the mating leaving a fir-tree-shaped gap between the root and the disc, fluidly sealing at least a part of the fir-tree-shaped gap, and attaching a cover plate to the upstream-facing side of the disc over the root.

In the method as defined herein, the step of fluidly sealing may include fluidly sealing at least the part of the fir-tree-shaped gap at the upstream-facing side of the disc.

BRIEF DESCRIPTION OF THE DRAWINGS

Reference is now made to the accompanying figures in which.

DETAILED DESCRIPTION

Figure 1:
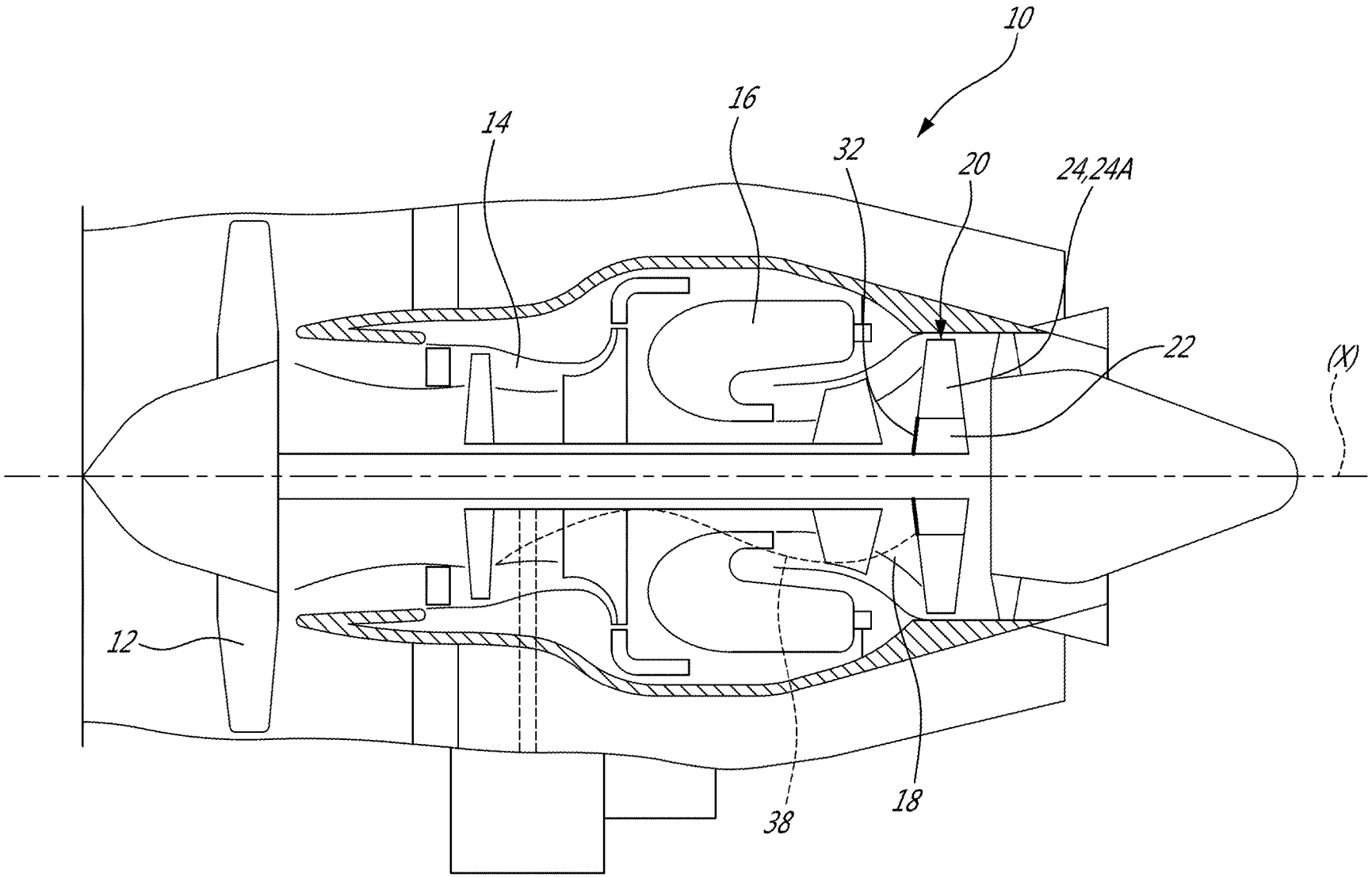
FIG. 1 is a schematic cross sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. In this embodiment the compressor section 14 and the turbine section 18 are rotatable about a rotation axis (X) of the engine 10. The turbine section 18 includes a turbine rotor 20 rotatable about the rotation axis (X) and implemented according to the present technology.

The turbine section 18 may include multiple turbine rotors 20 which may be implemented according to the present technology. While the present technology is illustrated with regard to a low pressure turbine rotor 20, the present technology may be implemented in one or more high pressure turbine rotors of the engine 10, instead of or in addition to being implemented with the low pressure turbine rotor 20. Also, while the present technology is illustrated with regard to turbine rotors, the present technology may also be implemented with regard to a compressor rotor for example.

As schematically shown in FIG. 1, the turbine rotor 20 includes a disc 22 connected to a respective shaft of the engine 10, and a plurality of turbine blades 24 connected to the disc 22. The blades 24 may be positioned at any circumferentially distributed locations about the disc 22 to form a circumferential array/pattern of blades that may be selected to suit each particular embodiment of the rotor 20 and/or the engine 10.

For the purposes of this document, the terms "laterally", "axially", "radially" and "circumferentially" used in relation to the turbine rotor 20 and its components, including the blades 24, are in reference to the rotation axis (X) of the turbine rotor 20. For the purposes of this document, the terms upstream and downstream and corresponding upstream and downstream directions are used relative to the direction of the flow of air through the turbine rotor 20 when the turbine rotor 20 is rotating to propel the engine 10 forward. For example, and "upstream-facing side" of a component would face the airflow through the turbine rotor 20.

Figure 2:
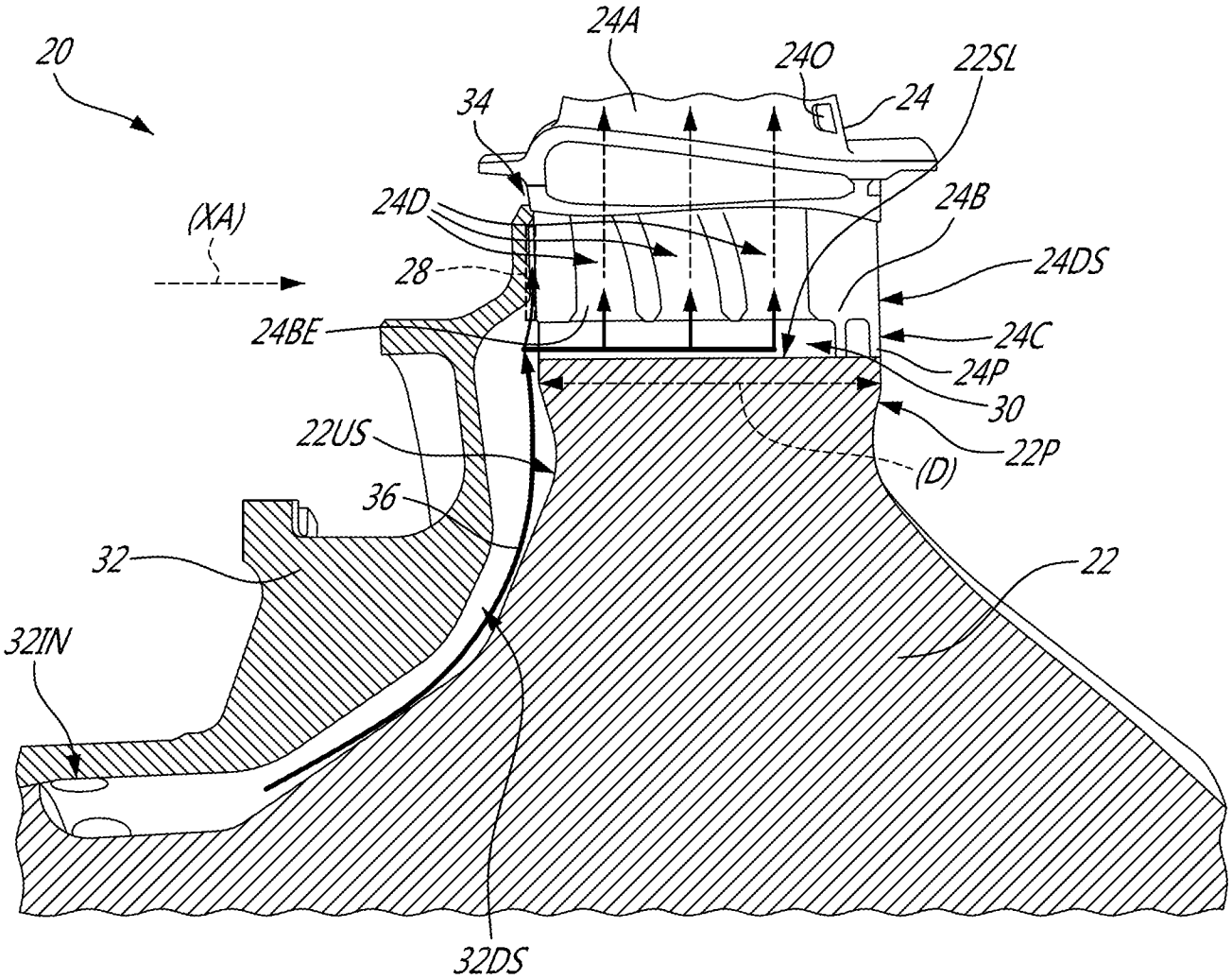
FIG. 2 is a section taken through a part of a turbine rotor of the gas turbine engine of FIG. 1, along a vertical plane passing through both a rotation axis and a turbine blade of the turbine rotor.

FIG. 2 shows a more detailed section taken through a part of the turbine rotor 20, more particularly a section taken along a plane passing through the rotation axis (X), the disc 22, and one of the blades 24. In this embodiment, and although this need not be the case in other embodiments, the blades 24 and corresponding slots 22SL in the disc 22 are similar to each other and therefore only one of the blades 24 and slots 22SL is shown in described in detail. As shown, the blade 24 has an airfoil portion 24A that extracts energy from gases passing through the turbine rotor 20 when the turbine rotor 20 is in use and converts the energy of the gases into rotation of the turbine rotor 20. The airfoil portion 24A may have any shape that may be suitable for each particular embodiment and application of the rotor 20.

The airfoil portion 24A is connected to, and in this embodiment integral with, a root 24B of the blade 24. The blade 24 defines air passages 24D therethrough, which extend from the root 24B into the airfoil portion 24A and terminate at openings 240 defined in an outer surface of the airfoil portion 24A. The number and arrangement of the air passages 24D and the openings 240 may be any number and arrangement selected to suit each particular embodiment and application of the turbine rotor 20.

Figure 3B:
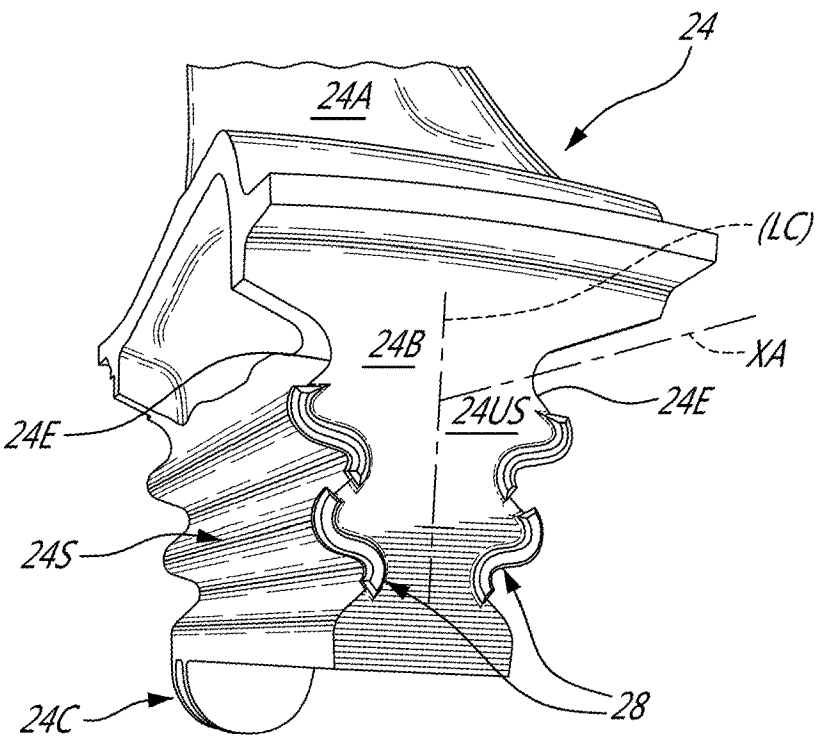
FIG. 3B is a perspective view taken from an upstream-facing side of a root and a part of an airfoil portion of the turbine blade of FIG. 3A.
Figure 3A:
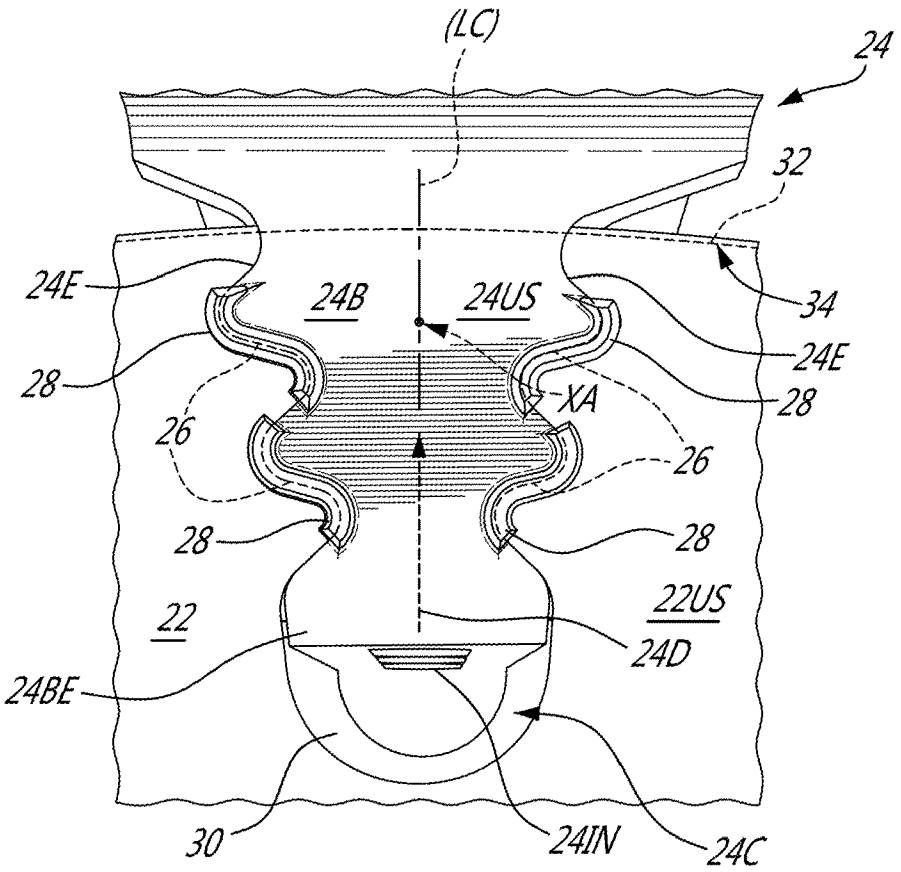
FIG. 3A is an elevation view of a part of an upstream-facing surface of a disc and the turbine blade of the turbine rotor of FIG. 2.

As shown in FIGS. 3A and 3B, in this embodiment the root 24B is lobed, for radially securing the blade 24 to the disc 22. In the depicted embodiment, the lobed root 24B includes multiple symmetrical lobes arranged generally in a fir-tree-shape. However, it is to be understood that other types of lobed blade roots may also be used, including dovetail shaped blade roots for example. As shown, in this embodiment, the fir-tree shape of the root 24B is defined by opposed sinusoidal lateral surfaces 24S of the root 24B that extend generally axially relative to the rotation axis (X) of the turbine rotor 20 when the turbine rotor 20 is assembled. As shown in FIG. 3A, the root 24B is matingly received in the disc 22, and more particularly in a corresponding fir-tree-shaped slot 22SL defined in the disc 22. More particularly, the slot 22SL conforms in shape, in the cross-section shown in FIG. 3A, to the shape of the root 24B in the same cross-section, and is slightly larger than the root 24B in that cross-section for allowing the root 24B to be slidingly and matingly received in the slot 22SL.

In other embodiments, the surface(s) of the root 24B and corresponding surface(s) of the disc 22 defining the slot 22SL receiving the root 24B may be selected differently while still defining the corresponding mating fir-tree shapes of the root 24B and the slot 22SL. As shown in FIG. 2, and although this need not be the case in other embodiments, the fir-tree-shaped slot 22SL in this embodiment axially extends through the disc 22, through an entire axial depth (D) of a peripheral portion 22P of the disc 22. As shown in FIG. 1, the fir-tree-shaped slots of the disc 22 receiving the respective ones of the roots 24B of the blades 24 are defined in the disc 22 at circumferentially distributed locations about the disc 22 to provide for the desired circumferentially distributed locations of the blades 24 as described above.

Although the slots 22SL are defined herein as being "generally axially", it is to be understood that they may in fact be inclined slightly (e.g. about 15 degrees to axial). For the sake of simplicity of explanation, the slots 22SL in the disc 22 will be said to be generally axially extending, despite this small angular inclination/skew angle.

Referring back to FIG. 3A, when the root 24B is received in the slot 22SL, parts of the lateral surfaces 24S of the root 24B engage corresponding parts of the disc 22 defining the slot 22SL in a radial direction relative to the rotation axis (X) of the turbine rotor 20 and thereby prevent the blade 24 from disconnecting from the disc 22 in a radial direction away from the rotation axis (X) when the turbine rotor 20 is in use. In some embodiments, when the root 24B is received in the slot 22SL, other parts of the lateral surfaces 24S of the root 24B and corresponding other parts of the disc 22 defining the slot 22SL may define one or more gaps 26 therebetween. Some parts of the gaps 26 are visible in FIG. 3, while other parts of the gaps 26 are shown schematically in FIG. 3A with dashed lines.

Still referring to FIG. 3A, in the present embodiment the root 24B includes tabs 28 on an upstream-facing surface 24US of the root 24B. The tabs 28 are connected to, and in this embodiment integral with, the root 24B of the blade 24, and are disposed on the upstream-facing surface 24US of the root 24B. In some embodiments, one or more of the tabs 28 need not be integral with the root 24B. As described in more detail below, the tabs 28 fluidly block at least parts of respective one(s) of the gaps 26. To this end, the tabs 28 extend along at least a portion the respective one(s) of the gaps 26, and laterally outward from a respective fir-tree-shaped edge 24E of the root 24B.

Further in this embodiment, as shown in FIG. 3A, and although this may not be the case in other embodiments, the tabs 28 along each of the edges 24E are spaced from each other. In an aspect, this helps improve stress distribution in the root 24B. In other embodiments, a given edge 24E of a given root 24B may have a single tab 28 covering one or more of the gap(s) 26 defined by that edge 24E. As a non-limiting example, in embodiments where a given edge 24E may define two or more gaps 26 between that edge 24E and the disc 22, that edge 24 may have a single tab 28 as described above, which tab 28 may cover at least a portion of at least one of the two or more gaps 26, and in some cases for example at least a portion of each of the two or more gaps 26.

As shown, in this embodiment the root 24B has two laterally opposed lobed edges 24E, which in this embodiment are fir-tree-shaped and are defined by the upstream-facing surface 24US of the root 24B and respective ones of the sinusoidal lateral surfaces 24S of the root 24B. Even more particularly in this embodiment, the tabs 28 extend along, or stated otherwise follow the respective portion of the curve of, the respective ones of the curved fir-tree-shaped edges 24E. That is, in this embodiment each of the tabs 28 is shaped to conform to a corresponding portion of the one of the fir-tree-shaped edges 24E along which that tab 28 extends. As an example, since in this embodiment and as shown in FIG. 3A, the gaps 26 are sinusoidal, the tabs 28 are correspondingly sinusoidal. While conforming shapes of the tabs 28 have been found to provide some advantages such as improved stress distribution in the tabs 28 and proximate parts of the root 24B, in other embodiments the tabs 28 may be shaped differently so long as their air-blocking functionality as described herein is provided.

Referring to FIG. 2, the root 24B is shaped at its radially bottom end 24BE such that, when inserted into a respective one of the slots 22SL, which in this embodiment is in a downstream axial direction that defines an axially extending axis (XA) which extends axially through the center of root 24B, substantially mid-point in a circumferential direction between the opposed edges 24E. The radially bottom end 24BE of the root 24B and a portion of the disc 22 defining the slot 22SL define therebetween an air passage 30. In use, the air passage 30 conveys air to the air passages 24D in the blade 24, more particularly in this embodiment via inlets 241N (FIG. 3A) of the air passages 24D defined in the radially bottom end 24BE of the root 24B.

As shown in FIG. 2, the air passage 30 is fluidly sealed at its axially rear end by a seal 24C. In this embodiment, the seal 24C is at a bottom of a downstream-facing surface 24DS of the root 24B, which is opposite the upstream-facing surface 24US of the root 24B. In this embodiment, and while this need not be the case in other embodiments, the seal 24C is defined in part by the downstream-facing surface 24DS. Also in this embodiment, and while this need not be the case in other embodiments, the seal 24C includes a plurality of projections 24P extending downward from a rest of the root 24B. The projections 24P conform in shape to a bottom portion of the respective one of the slots 22SL and sealingly contact the bottom portion of the respective one of the slots 22SL. It is contemplated that the seal 24C may be a different type of seal and-or may not be integral with the root 24B.

Referring to FIG. 2, after the roots 24B of all of the blades 24 have been inserted by into respective ones of the slots 22SL in the disc 22, the blades 24 are axially secured to the disc 22 by a cover plate 32. In some embodiments, the cover plate 32 may be a conventional cover plate. As shown, in this embodiment the cover plate 32 may cover the upstream-facing side 22US of the disc 22, and at least a part of each of the roots 24B of the blades 24. The cover plate 32 may be attached to the disc 22 in any suitable way, such any suitable conventional way using fasteners, and thereby axially secures the roots 24B, and the blades 24, to the disc 22. Stated otherwise, the cover plate 32 prevents the roots 24B from exiting the slots 22SL in an upstream axial direction opposite to the downstream axial direction (XA).

As shown in FIG. 2, and schematically in FIG. 3A, the cover plate 32 is disposed axially over the tabs 28 and contacts the root 24B of each blade 24 along a sealed interface 34 extending radially outward of the tabs 28. The tabs 28 are accordingly disposed between the cover plate 32 and the disc 22. As shown, the sealed interface 34 is defined in this embodiment by sealing contact between a circumferential edge of the cover plate 32 with the upstream-facing surface 24US of each root 24B and the upstream-facing surface 22US of the disc 22. In other embodiments, the sealed interface 34 may include and-or be defined by one or more seals.

As shown in FIG. 2, when attached, the cover plate 32 defines an annular air passage 36 between a downstream-facing surface 32DS of the cover plate 32 and the upstream-facing surface 22US of the disc 22. When the turbine rotor 20 is in use, the annular air passage 36 supplies air to each of the air passages 30 in each of the slots 22SL, and hence to each of the air passages 24D in each of the blades 24. In other embodiments, the air passage 36 may not be annular and-or may be a plurality of air passages arranged to provide for the functionality described herein.

To supply air to the air passage 36, the cover plate 32 defines therein one or more inlets 32IN. These inlet(s) may be connected, when the turbine rotor 20 is in use, to one or more suitable sources of air. As a non-limiting example, and as shown with dashed line 38 in FIG. 1, in embodiments in which the turbine rotor 20 is used in the gas turbine engine 10 in the turbine section 18, the air passage 36 may be fluidly connected to a suitable part of the compressor section 14 of the engine 10 to receive compressed air therefrom.

When the rotor 20 is in use, the sealed interface 34 provided by the cover plate 32 directs air to the air passages 24D and 30, and-or stated otherwise prevents or at least limits air from escaping the air passages 30, 36 via the interface 34. In turn, the tabs 28 fluidly block at least parts of the gaps 26 as described above, between the disc 22 and the roots 24B of the blades 24. The tabs 28 may thus help limit or prevent air from escaping the air passages 30, 36 via the gaps 26 and hence help direct more air from the air passage 36 to the air passages 30 and 24D. In yet another aspect, in the present embodiment the tabs 28 of each of the blades 24, by engaging the upstream-facing surface 22US of the disc 22, may provide a retention feature and-or an axial positioning feature of that blade 24 with respect to the disc 22. The retention feature may help prevent the roots 24B from exiting the slots 22SL in the downstream axial direction (DD).

Figure 4:
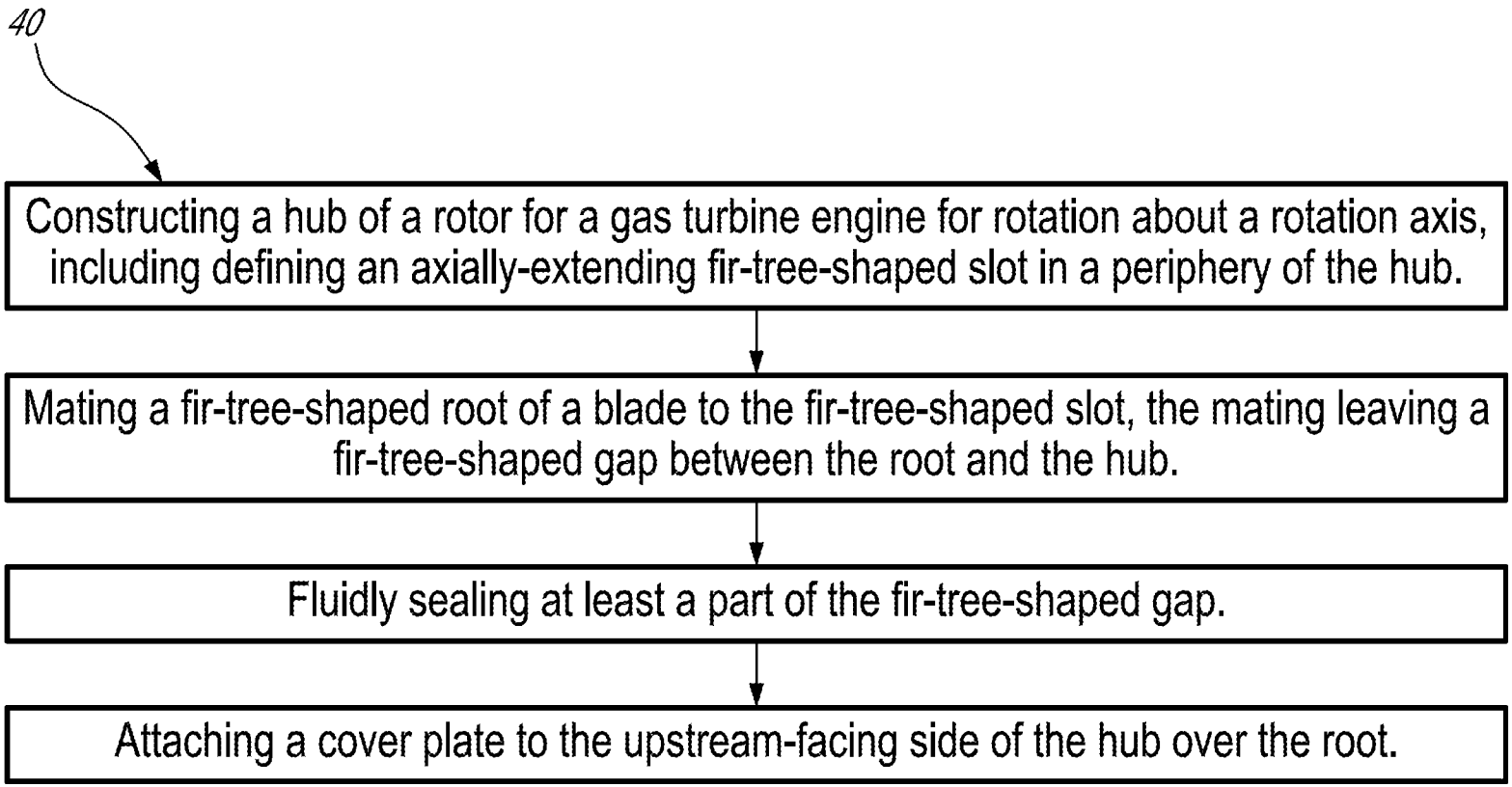
FIG. 4 is a diagram showing a method of constructing a turbine rotor of a gas turbine engine.

Now referring to FIG. 4, the present technology further provides a method 40 of constructing a turbine rotor assembly of a gas turbine engine 10. Such a turbine rotor assembly may for example comprise for example the disc 22 and at least one of the blades 24 engaged to the disc 22 as described above. In some embodiments, the method 40 may include constructing a disc 22 of a turbine rotor 20 for rotation about a rotation axis (X), including defining an axially-extending fir-tree-shaped slot 22SL in a periphery 22P of the disc 22, such as using a conventional manufacturing method for example.

In some embodiments, the method 40 may also include mating, such as described above for example, a fir-tree-shaped root 24B of a turbine blade 24 to the fir-tree-shaped slot 22SL, the mating leaving a fir-tree-shaped gap 26 between the root 24B and the disc 22. In some embodiments, the method 40 may also include fluidly sealing at least a part, such as a lateral portion for example, of the fir-tree-shaped gap 26. As seen above for example, in some embodiments the sealing may include sealing at least that part of the gap 26 at the upstream-facing side 22US of the disc 22. In some embodiments, the method 40 may also include attaching one or more cover plates 32 to the disc 22, such as to the upstream-facing side 22US of the disc 22 for example, over the roots 24 of the turbine blades 24.

In some embodiments, one or more cover plates 32 may be attached in this way to both the upstream-facing surface 22US of the disc 22 and to a downstream-facing surface of the disc 22. Understandably, the downstream-facing surface of the disc 22 may be opposite the upstream-facing surface 22US of the disc 22. As seen above, in some embodiments, the attaching of the cover plate(s) 32 may help axially secure the blades 24 to the disc 22. In embodiments where the cover plate(s) 32 is-are made of multiple components, the attaching the cover plate(s) 32 may correspondingly include correspondingly attaching each of the multiple components to each other and-or to the disc 22 for example, as may be applicable in each given possible embodiment.

In some embodiments, the method 40 may continue with steps similar to those described above with respect to one or more of the other blade(s) 24 and slot(s) 22SL of the disc 22 to complete a given rotor, such as the turbine rotor 20 for example, from the turbine rotor assembly. Understandably, in at least some such cases, the cover plate(s) 32 may be attached to the disc 22 after the rest of the blade(s) 24 have been mated to the disc 22 as described above.

In some embodiments, such as for example where the method 40 is used to make a turbine rotor 20, the method 40 may also include defining an air passage, such as defined by air passages 36, 30, 24D for example, extending as shown in FIG. 2 for example from a point between the cover plate 32 and the upstream-facing side 22US of the disc 22, into the root 24B of the turbine blade 2, and then into an airfoil portion 24A the turbine blade 24. In such embodiments, when the rotor 20 is in use, the air passage(s) 36, 30, 24D may provide air to the blades 24, such as for example to outer surfaces of the blades 24. The air may help cool the blades 24.

The embodiments described above may be manufactured using material(s) and manufacturing and assembly methods, such as conventional material(s) and manufacturing and assembly methods, which may be selected to suit each particular embodiment and application of the engine 10 and turbine rotor 20. The above description is meant to be exemplary only, and one skilled in the art will recognize that changes may be made to the embodiments described without departing from the scope of the technology disclosed.

For example, while the tabs 28 of the root 24B of each blade 24 in the embodiments described above are attached to the root 24B, in other embodiments one or more of the tabs 28 may be attached to the cover plate 32 at corresponding locations that may provide for the positioning of the one or more tabs 28 over at least parts of corresponding one or more of the gaps 26 as described above. As another example, the tabs 28 in the illustrated embodiments may be made of the same material as the respective ones of the roots 24B. In other embodiments, this need not be the case.

As another example, while the air passages 24D, 30, 36 are described above as separate interconnected air passages, the air passages 24D, 30, 36 may also be referred to as a single air passage extending through the turbine rotor 20 as described above with regard to each of the air passages 24D, 30, 36 separately. As yet another example, while the tabs 28 described above may help axially position and axially secure the blades 24 relative to the disc 22, in other embodiments the disc 22 may have features to provide this functionality, in addition to or instead of the tabs 28.

Still other modifications which fall within the scope of the present technology will be apparent to those skilled in the art, in light of a review of this disclosure.

The invention claimed is:

1. A turbine blade adapted to be mounted to a disc, the disc having a lobed slot therein for receiving the turbine blade, the turbine blade comprising:

an airfoil;

a root connected to the airfoil and adapted to be received with the lobed slot of the disc, the root defining an axis that extends axially therethrough, the root defining lobes having lateral surfaces extending axially between an upstream-facing surface and a down-stream facing surface of the root, the lateral surfaces of the lobes having lobed edges formed at junctions between the upstream-facing surface and the lateral surfaces of the root;

an air passage extending through the airfoil and the root;

a first tab connected to the upstream-facing surface of the root, the first tab being upstream of and axially spaced apart from the lateral surfaces of the lobes, an outer portion of the first tab extending laterally outward from a first edge of the lobed edges to overlap an upstream surface of the disc, at least the outer portion of the first tab having a shape conforming to that of the first edge; and a second tab connected to the upstream-facing surface of the root, the second tab being upstream of and axially spaced apart from the lateral surfaces of the lobes, an outer portion of the second tab extending laterally outward from a second edge of the lobed edges in a direction opposite the first tab such as to overlap an upstream surface of the disc, at least the outer portion of the second tab having a shape conforming to that of the second edge.

2. The turbine blade of claim 1, wherein the first tab is a plurality of first tabs extending along the first edge, and the second tab is a plurality of second tabs extending along the second edge.

3. The turbine blade of claim 2, wherein the first tabs are spaced from each other along the first edge and the second tabs are spaced from each other along the second edge.

4. The turbine blade of claim 1, comprising a seal at a radially inner end of the downstream-facing surface of the root.

5. The turbine blade of claim 4, wherein the seal includes a plurality of projections extending radially inward from the root, and the seal is defined in part by the downstream-facing surface.

6. The turbine blade of claim 1, wherein the lobed edges are fir-tree shaped, the first and second tabs being in shape.

7. A turbine rotor, comprising a turbine disc which is rotatable about a rotation axis and the turbine blade of claim 1 mounted thereto, the disc defining the lobed slot therein, the root of the turbine blade received in the lobed slot, the airfoil portion of the turbine blade extending radially outward from the lobed slot and the disc relative to the rotation axis, a lateral gap defined between at least one of the lateral surfaces of the root and the lobed slot in the disc, the first and second tabs extending laterally away from the root a distance greater than said lateral gap to abut the upstream surface of the disc.

8. The turbine rotor of claim 7, wherein the air passage is a first air passage, the root, the seal, and the disc define a second air passage between the root, the seal, and the disc, the first air passage being fluidly connected to the second air passage.

9. The turbine rotor of claim 7, comprising a cover plate attached to the upstream surface of the disc, the cover plate and the upstream-facing surface of the disc defining a third air passage between the cover plate and the upstream-facing surface of the disc, the third air passage being fluidly connected to the second air passage.

10. The turbine rotor of claim 7, wherein the first and second tabs fluidly block at least parts of corresponding ones of the lateral gap defined between the lateral surfaces of the root and the lobed slot in the disc.

11. The turbine rotor of claim 10, wherein the first and second tabs are disposed between the root and the cover plate.

12. The turbine rotor of claim 11, wherein the lobed slot is a fir-tree-shaped slot, a plurality of the fir-tree-shaped slots defined in the disc at circumferentially distributed locations about a periphery of the disc, and a plurality of turbine blades each having the root thereof received in a corresponding one of the fir-tree-shaped slots.

13. The turbine blade of claim 1, wherein the first and second tabs extend laterally over a gap formed between the lobed edges and the slot when the root of the turbine blade is mounted in the slot, the first and second tabs being upstream of the gap.

14. The turbine blade of claim 1, wherein a radially inner end of the upstream-facing surface of the root is free of the first and second tabs.

15. A turbine rotor for a gas turbine engine, comprising:

a disc rotatable about a rotation axis and having a circumferential array of slots therein, slots extending generally axially in the disc relative to the rotation axis;

a plurality of turbine blades received in the slots, the blades having fir-tree-shaped roots configured with the slot to form a mating connection between the disc and the turbine blades;

the turbine blades having one or more tabs located on an upstream-facing surface of the fir-tree-shaped roots, the one or more tabs extending laterally outward from a lateral outer edge of the fir-tree-shaped roots on circumferentially opposite sides of the fir-tree-shaped roots, the one or more tabs extending laterally in an circumferential direction over an upstream surface of the disc thereby sealing a lateral portion of a gap defined between the fir-tree-shaped roots and the disc, the one or more tabs having a shape conforming to the lateral outer edge of the fir-tree-shaped roots, a radially inner end of the upstream surface of the fir-tree-shaped roots being free of the one or more tabs; and a cover plate connected to an upstream-facing side of the disc and defining a first air passage between the cover plate and the disc, and wherein the disc and the given turbine blade define a second air passage fluidly connected to the first air passage extending through the root of the given turbine blade to an airfoil portion of the given turbine blade.

16. The turbine rotor of claim 15, wherein the one or more tabs are integrally formed with the fir-tree-shaped roots.

17. The turbine rotor of claim 16, wherein the one or more tabs include a plurality of tabs spaced apart from each other and conforming in shape to the lateral outer edges of the fir-tree-shaped roots.

* * * * *